US010392933B2

(12) United States Patent
Yao et al.

(10) Patent No.: US 10,392,933 B2
(45) Date of Patent: Aug. 27, 2019

(54) MULTIPLE DOWNHOLE SENSOR DIGITAL ALIGNMENT USING SPATIAL TRANSFORMS

(71) Applicant: Baker Hughes, a GE company LLC, Houston, TX (US)

(72) Inventors: Richard Jin Yao, The Woodlands, TX (US); Eric C. Sullivan, Houston, TX (US); Navish Makkar, Celle (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 568 days.

(21) Appl. No.: 14/928,722

(22) Filed: Oct. 30, 2015

(65) Prior Publication Data

US 2017/0122099 A1 May 4, 2017

(51) Int. Cl.
*E21B 49/00* (2006.01)
*E21B 44/00* (2006.01)
(Continued)

(52) U.S. Cl.
CPC ..... *E21B 49/003* (2013.01); *E21B 44/00* (2013.01); *E21B 47/024* (2013.01); *G01C 21/16* (2013.01)

(58) Field of Classification Search
None
See application file for complete search history.

(56) References Cited

U.S. PATENT DOCUMENTS 4,510,696 A * 4/1985 Roesler ..... E21B 47/022 33/304
5,155,916 A * 10/1992 Engebretson ..... E21B 47/022 33/302
(Continued)

FOREIGN PATENT DOCUMENTS

CA 2953520 A1 * 12/2015 ..... G01P 15/00
EP 2759674 A2 * 7/2014 ..... G01C 19/38
(Continued)

OTHER PUBLICATIONS

International Search Report for International Application PCT/US2016/058224 dated Feb. 1, 2017, 4 pages.
(Continued)

*Primary Examiner* — Janet L Suglo
*Assistant Examiner* — Leonard S Liang
(74) *Attorney, Agent, or Firm* — TraskBritt

(57) ABSTRACT

Wellbore sensor systems and related methods are disclosed. A wellbore sensor system includes a first sensor node and a second sensor node. The first sensor node is operably coupled to a drill string at a first location. The second sensor node is operably coupled to the drill string at a second location. A method includes taking first sensor readings from the first sensor node relative to a first spatial frame of reference, and taking second sensor readings from the second sensor node relative to a second spatial frame of reference, and using the first sensor readings and the second sensor readings to estimate parameters of a mathematical transform configured to transform the second sensor readings into the first spatial frame of reference. The method also includes transforming the second sensor readings into the first spatial frame of reference with the estimated mathematical transform.

20 Claims, 6 Drawing Sheets

(51) Int. Cl.
*E21B 47/024* (2006.01)
*G01C 21/16* (2006.01)

(56) References Cited

U.S. PATENT DOCUMENTS 5,172,480 A * 12/1992 Labuc ..... E21B 47/022 324/346
5,402,392 A * 3/1995 Lu ..... G01V 1/46 166/254.2
5,506,769 A * 4/1996 Fu ..... G01V 5/045 250/269.3
5,512,830 A * 4/1996 Kuckes ..... E21B 47/00 324/346
6,453,239 B1 * 9/2002 Shirasaka ..... E21B 47/022 175/45
6,480,119 B1 * 11/2002 McElhinney ..... E21B 47/022 175/40
6,882,937 B2 * 4/2005 McElhinney ..... E21B 47/022 702/10
7,002,484 B2 * 2/2006 McElhinney ..... E21B 47/022 166/255.2
7,117,605 B2 * 10/2006 Ekseth ..... E21B 47/022 33/304
9,360,581 B2 * 6/2016 Clark ..... E21B 47/024
2009/0084546 A1 * 4/2009 Ekseth ..... E21B 47/04 166/255.1
2009/0166031 A1 7/2009 Hernandez
2013/0076526 A1 * 3/2013 Schuberth ..... E21B 47/00 340/853.8
2013/0211723 A1 * 8/2013 Weston ..... E21B 47/022 702/6
2015/0106016 A1 * 4/2015 Wu ..... G01V 3/30 702/6
2015/0331138 A1 * 11/2015 Estes ..... G01V 3/26 324/346
2015/0378043 A1 * 12/2015 Brooks ..... G01P 15/00 702/9

FOREIGN PATENT DOCUMENTS

WO 0139412 A1 5/2001
WO 2014100275 A1 6/2014
WO 2015099779 A1 7/2015
WO 2015153537 10/2015

OTHER PUBLICATIONS

International Written Opinion for International Application PCT/US2016/058224 dated Feb. 1, 2017, 4 pages.

* cited by examiner

MULTIPLE DOWNHOLE SENSOR DIGITAL ALIGNMENT USING SPATIAL TRANSFORMS

FIELD

Embodiments of the present disclosure relate generally to wellbore sensor systems, and more particularly to wellbore sensor systems including multiple sensor nodes.

BACKGROUND

The use of sensors in a wellbore is known in the art. One example of a sensor used in a wellbore while drilling is the MULTISENSE™ dynamics mapping system, offered commercially by Baker Hughes Incorporated, of Houston, Tex. The MULTISENSE™ dynamics mapping system records up to 200 hours of dynamics event measurements, including torsional, axial, and lateral vibrations and revolutions per minute (RPM), as well as downhole weight-on-bit (WOB) and torque-on-bit measurements.

The use of sensors, such as the MULTISENSE™ dynamics mapping system while drilling has, among other benefits, increased drilling efficiency, and reduced nonproductive time (NPT). There is a demand, however, for further improvement in drilling efficiency and reduction in NPT.

BRIEF SUMMARY

Disclosed in some embodiments herein is a wellbore sensor system including a drill string operably coupled to a drilling element configured to drill through a formation, and a plurality of sensor nodes. The plurality of sensor nodes includes at least a first sensor node and a second sensor node. The first sensor node is operably coupled to the drill string at a first location and includes one or more first sensors including a first spatial sensor. The second sensor node is operably coupled to the drill string at a second location offset from the first location along a length of the drill string. The second sensor node includes one or more second sensors including a second spatial sensor. The wellbore sensor system also includes a wellbore communication system operably coupled to each of the plurality of sensor nodes and configured to enable the plurality of sensor nodes to transmit sensor data through the wellbore communication system. The wellbore sensor system further includes one or more control circuits operably coupled to the wellbore communication system, and configured to receive the sensor data from the first sensor node and the second sensor node. The one or more control circuits each include a processor operably coupled to a data storage device. The data storage device includes computer-readable instructions stored thereon. The processor is configured to execute the computer-readable instructions stored on the data storage device. The computer-readable instructions are configured to instruct the processor to estimate, using the sensor data from the first spatial sensor and the second spatial sensor, parameters of a mathematical transform configured to transform sensor readings from the second sensor node in a second spatial frame of reference of the second sensor node into a first spatial frame of reference of the first sensor node. The computer-readable instructions are also configured to instruct the processor to transform the sensor readings from the second sensor node into the first spatial frame of reference using the estimated mathematical transform.

Disclosed in some embodiments herein is a method of transforming wellbore sensor data into a common spatial frame of reference. The method includes taking first sensor readings with a first sensor node operably coupled to a drill string at a first location, the first sensor readings taken relative to a first spatial frame of reference of the first sensor node. The method may also include taking second sensor readings with a second sensor node operably coupled to the drill string at a second location offset from the first location along the length of the drill string. The second sensor readings are taken relative to a second spatial frame of reference of the second sensor node. The method further includes executing computer-readable instructions stored on a data storage device with a processor. The computer-readable instructions are configured to instruct the processing element to use the first sensor readings and the second sensor readings to estimate parameters of a mathematical transform configured to transform the second sensor readings into the first spatial frame of reference, and transform the second sensor readings into the first spatial frame of reference with the estimated mathematical transform.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1A:
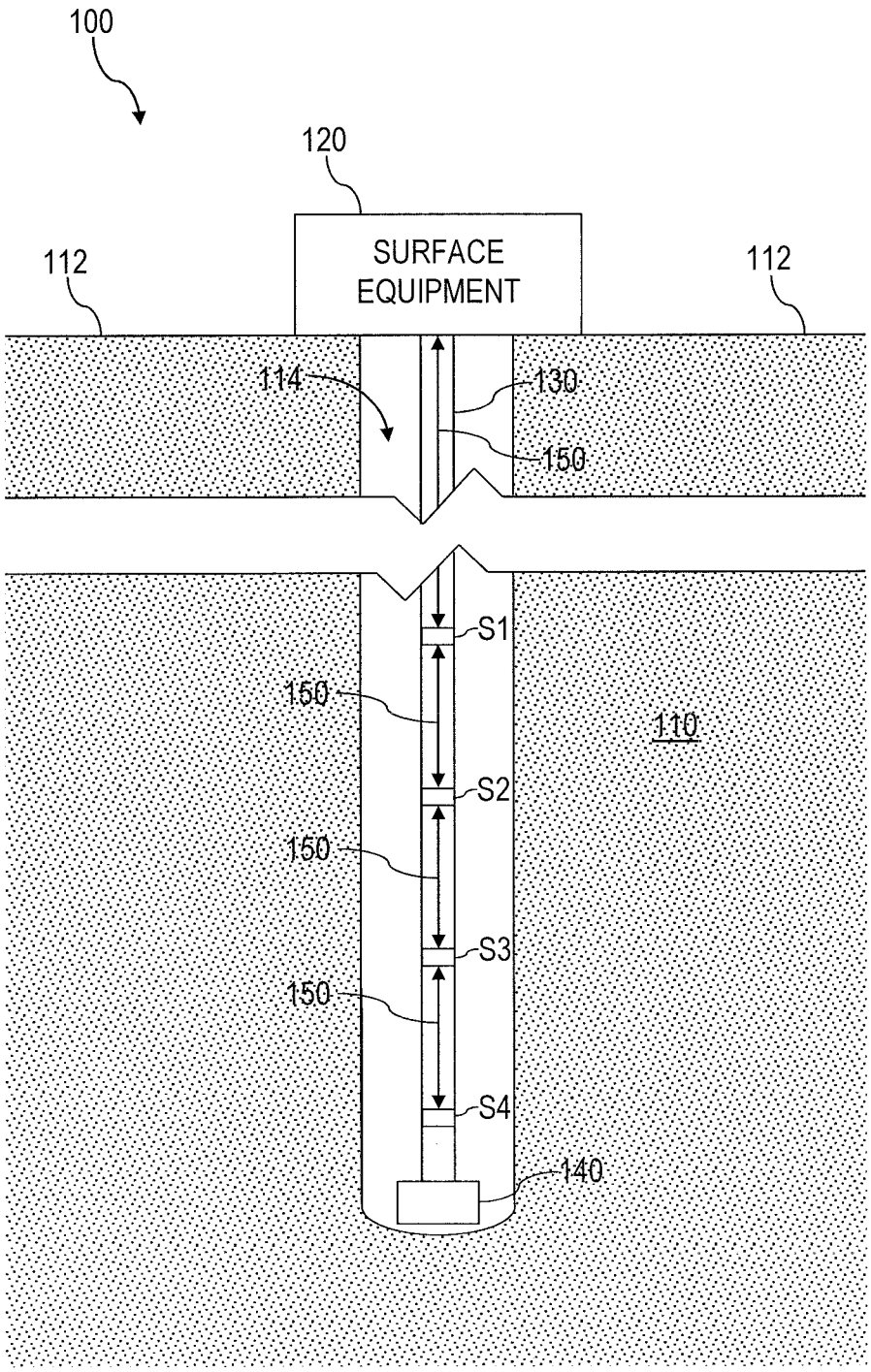
FIG. 1A is a simplified schematic diagram of a wellbore sensor system.

In the following detailed description, reference is made to the accompanying drawings which form a part hereof, and in which is shown by way of illustration, specific embodiments in which the disclosure may be practiced. These embodiments are described in sufficient detail to enable those of ordinary skill in the art to practice the disclosure. It should be understood, however, that the detailed description and the specific examples, while indicating examples of embodiments of the disclosure, are given by way of illustration only and not by way of limitation. From this disclosure, various substitutions, modifications, additions rearrangements, or combinations thereof within the scope of the disclosure may be made and will become apparent to those of ordinary skill in the art.

In addition, some of the drawings may be simplified for clarity. Thus, the drawings may not depict all of the components of a given apparatus (e.g., device) or method. In addition, like reference numerals may be used to denote like features throughout the specification and figures.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the disclosure may be implemented on any number of data signals including a single data signal.

Embodiments of the disclosure include systems and related methods for transforming sensor data from multiple downhole sensor nodes into a common spatial frame of reference. It should be noted that while the utility and application of the various embodiments of the disclosure are described with reference to downhole sensor nodes, the disclosure also finds application to any environment where sensor data is available from multiple sensor nodes having different spatial frames of reference.

As used herein, the term "spatial sensor" refers to a motion sensor (e.g., an accelerometer, etc.), a position sensor, an orientation sensor (e.g., a magnetometer, a gyroscope, etc.), and combinations thereof. By way of non-limiting example, a spatial sensor may include a three-axis accelerometer. Also by way of non-limiting example, a spatial sensor may include a magnetometer configured to detect a far-field magnetic field of the earth.

As used herein, the term "spatial data" refers to data from a spatial sensor indicating motion, orientation, position, or combinations thereof.

As used herein, the terms "operably couple," "operably coupled," "operably coupling," and other forms of the term "operably couple" refer to both wireless and wired connections. "Operably couple," and its other forms may also refer to both direct (i.e., nothing coupled in between operably coupled components) and indirect (i.e., other components coupled in between operably coupled components) connections.

FIG. 1A is a simplified schematic diagram of a wellbore sensor system 100. The wellbore sensor system 100 may include a drill string 130 operably coupled to a plurality of sensor nodes S1, S2, S3, and S4. Each of the sensor nodes S1, S2, S3, and S4 may be spatially offset from each of the others of the sensor nodes S1, S2, S3, and S4 along a length of the drill string 130. Each of the sensor nodes S1, S2, S3, and S4 may be configured to provide sensor data corresponding to readings taken by sensors in the sensor nodes S1, S2, S3, and S4. As each of the sensor nodes S1, S2, S3, and S4 is located at a different location along the drill string 130, the sensor data from the various sensor nodes S1, S2, S3, and S4 may not be taken with reference to a common frame of reference (i.e., vertices of conceptual coordinate systems describing the frames of reference corresponding to the sensor nodes S1, S2, S3, and S4 may be located in different locations). Moreover, orientations of the various sensor nodes S1, S2, S3, and S4 may not be aligned (i.e., reference axes of the conceptual coordinate systems describing the frames of reference may not point in the same direction). In other words, the sensor data taken from sensor nodes S1, S2, S3, and S4 may be taken with reference to different spatial frames of reference corresponding to each of the sensor nodes S1, S2, S3, and S4. These different spatial frames of reference may differ in position, orientation, or a combination thereof.

Figure 1B:
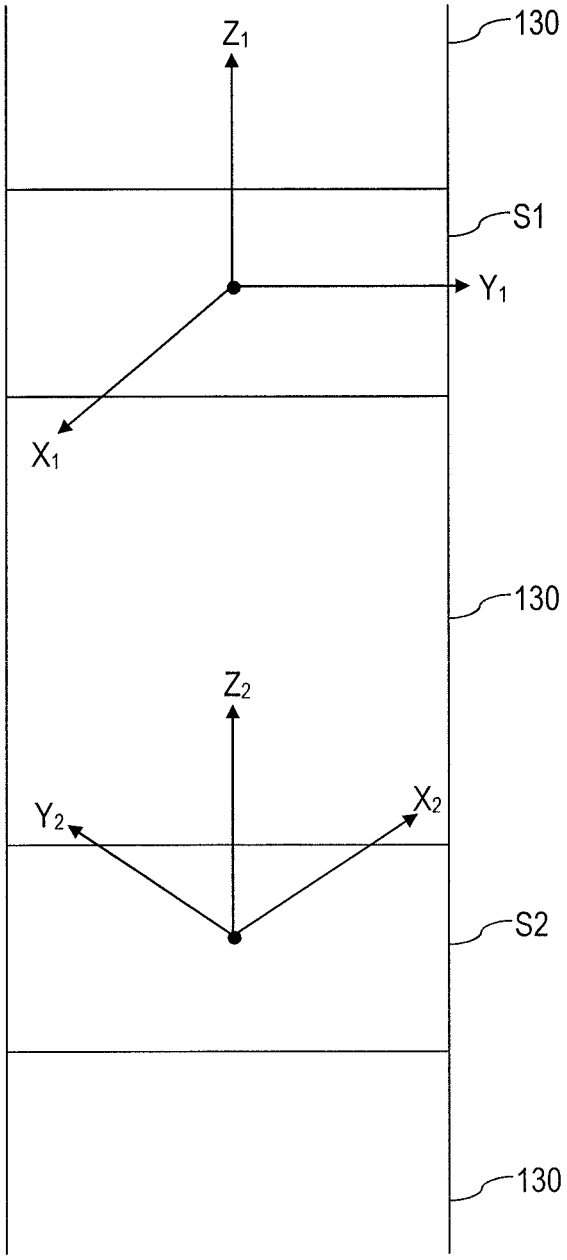
FIG. 1B illustrates a portion of a drill string and sensor nodes of the wellbore sensor system of FIG. 1A.

FIG. 1B illustrates a portion of the drill string 130 and sensor nodes S1 and S2 of the wellbore sensor system 100 of FIG. 1A. As previously discussed, the sensor data taken from sensor nodes S1, S2, S3, and S4 may be taken with reference to different spatial frames of reference. FIG. 1B illustrates this concept as it relates to sensor nodes S1 and S2. For example, sensor data taken by sensor node S1 may be taken with reference to a first spatial frame of reference having coordinate axes $X_1$, $Y_1$, and $Z_1$, and vertex $V_1$. In contrast, sensor data taken by sensor node S2 may be taken with reference to a second spatial frame of reference having coordinate axes $X_2$, $Y_2$, and $Z_2$, and vertex $V_2$. As may be observed by inspecting FIG. 1B, the vertices $V_1$ and $V_2$ of the first and second spatial frames of reference are located at different spatial locations. Also, although the axes $Z_1$ and $Z_2$ of the first and second spatial frames of reference appear to be pointing in about the same direction, the axes $X_1$ and $X_2$ do not point in the same direction, and the axes $Y_1$ and $Y_2$ do not point in the same direction. Accordingly, sensor data from sensor nodes S1 and S2 may not, without modifications, be readily combined to together paint a more complete picture of sensed environmental features. Embodiments of the disclosure include systems and methods for generating mathematical transforms configured to transform sensor data from multiple sensor nodes S1, S2, S3, and S4 (FIG. 1A), and for transforming the sensor data using the generated mathematical transforms into a common spatial frame of reference.

Returning to FIG. 1A, the wellbore sensor system 100 may be configured to digitally align the sensor data provided by each of the plurality of sensor nodes S1, S2, S3, and S4. For example, the wellbore sensor system 100 may be configured to generate mathematical transforms that transform the sensor data from each of the sensor nodes S1, S2, S3, and S4 into a common spatial frame of reference. Accordingly, after the mathematical transforms are applied to the sensor data from each of the sensor nodes S1, S2, S3, and S4, spatial relations between environmental conditions detected by separate ones of the sensor nodes S1, S2, S3, and S4 may be assessed. By way of non-limiting example, one of the sensors S1, S2, S3, or S4 may be selected to be a master sensor node, and the sensor data from each of the others of the sensor nodes S1, S2, S3, and S4 may be transformed into a spatial frame of reference of the master sensor node.

Each of the sensor nodes S1, S2, S3, and S4 may include at least one spatial sensor (e.g., an accelerometer, a magnetometer, a gyroscope, etc.) configured to provide spatial data indicating motion, orientation, position, or combinations thereof of the sensor node S1, S2, S3, or S4 that corresponds thereto. The wellbore sensor system 100 may be configured to use the spatial data to generate the mathematical transforms.

In some embodiments, each of the sensor nodes S1, S2, S3, and S4 may also include other sensors. By way of non-limiting example, the sensor nodes S1, S2, S3, and S4 may include temperature sensors, pressure sensors, elevation sensors, acoustic sensors, electromagnetic wave sensors (e.g., radio frequency, infrared, light, ultraviolet, etc.), other sensors, and combinations thereof. Sensor data from these sensors may be transformed using the mathematical transforms into a common frame of reference.

The drill string 130 may also be operably coupled to surface equipment 120 and a drilling element 140. The drilling element 140 may be configured to drill a wellbore 114 through a formation 110. The surface equipment 120 may be located on a surface 112 of the formation 110. The surface equipment 120 may be configured to control deployment of the drill string 130 into the wellbore 114, and rotation of the drill string 130 and the drilling element 140.

In some embodiments, the wellbore sensor system 100 may also include a wellbore communication system 150 operably coupled to each of the plurality of sensor nodes S1, S2, S3, and S4. The wellbore communication system 150 may be configured to enable each of the plurality of sensor nodes S1, S2, S3, and S4 to transmit sensor data through the wellbore communication system 150. In some embodiments, the wellbore communication system 150 may also be operably coupled to the surface equipment 120, and configured to enable the surface equipment to receive at least one of the sensor data (e.g., if the surface equipment 120 includes control circuitry configured to generate the mathematical transforms) and the transformed sensor data (e.g., if control circuitry configured to generate the mathematical transforms is located in the wellbore 114, at for example, one or more of the sensor nodes S1, S2, S3, and S4) through the wellbore communication system 150 in real time.

The wellbore communication system 150 may include any communication system capable of enabling the sensor signals to be transmitted in the wellbore 114. By way of non-limiting example, the wellbore communication system 150 may include any of a mud pulse telemetry system, a radio frequency signal telemetry system, an electromagnetic telemetry system, an acoustic signal telemetry system, a wired-pipe telemetry system (e.g., including electrical conductors, optical fibers, or a combination thereof), a galvanic telemetry system, or combinations thereof.

In other embodiments, each sensor node S1, S2, S3, and S4 may include a dedicated, non-transitory memory 201 (see FIG. 2) operably connected to the respective sensor node S1, S2, S3, or S4. The dedicated, non-transitory memory 201 may be configured to collect and store sensor data from the respective sensor node sensor node S1, S2, S3, or S4. One or more control circuits may be physically separate from the drill string (e.g., at a central data analysis center for drilling operations) and may be configured to receive the sensor data from the sensor nodes S1, S2, S3, and S4 after drilling is complete to analyze, and optionally mathematically transform, the sensor data. For example, a dedicated, non-transitory memory 201 may be mechanically and operably connected to each sensor node S1, S2, S3, and S4.

Although the wellbore sensor system 100 of FIG. 1A includes four sensor nodes S1, S2, S3, and S4, it is contemplated within the scope of the disclosure that the wellbore sensor system 100 may include any number of sensor nodes that is greater than or equal to two. As long as there are two or more sensor nodes that may be located and/or oriented differently from each other, it may be beneficial to generate mathematical transforms to transform the sensor data into a common spatial frame of reference. Also, one or more additional sensor nodes may be located on or in the drilling element 140, in some embodiments.

Figure 2:
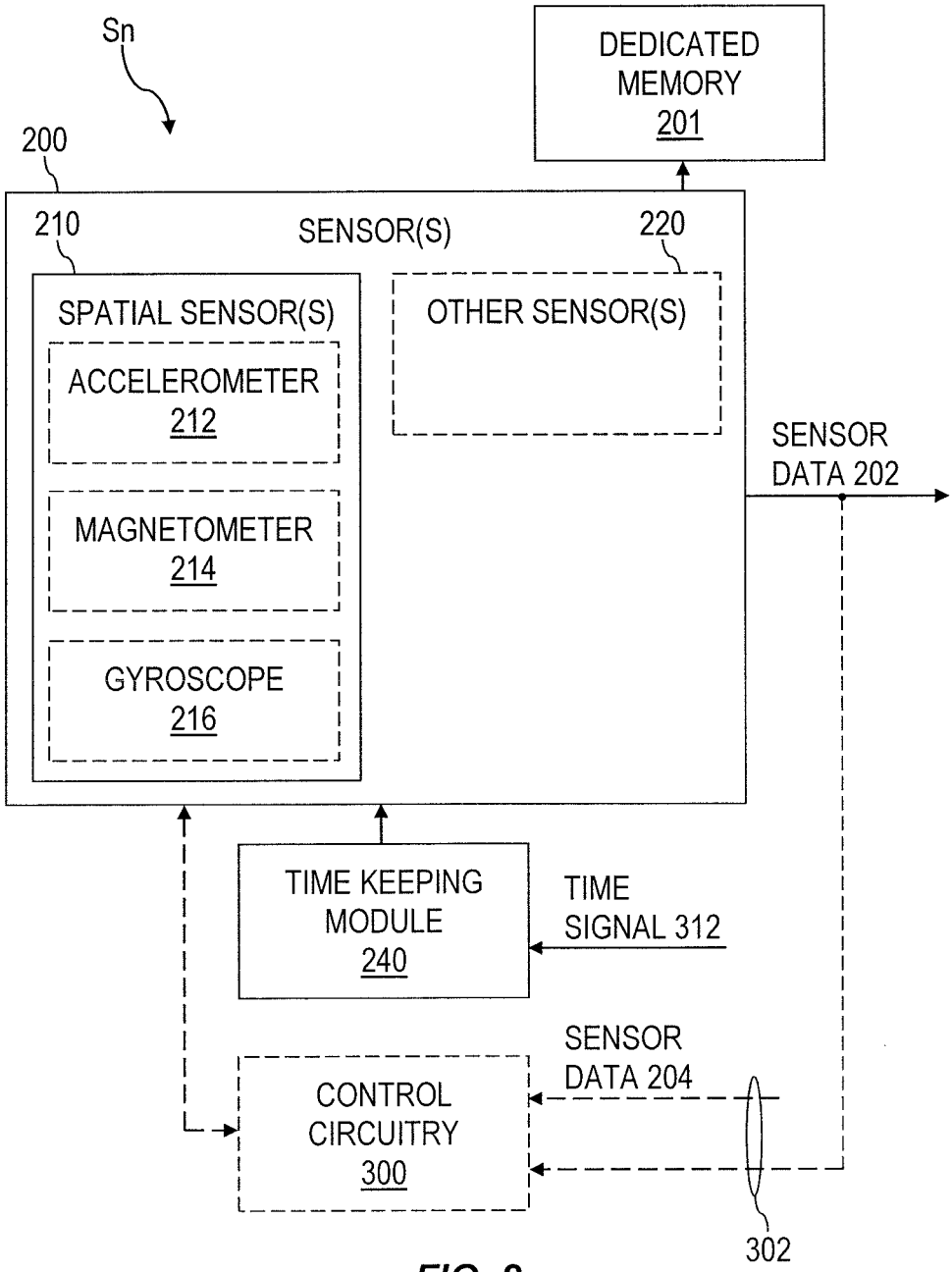
FIG. 2 is a simplified block diagram of a sensor node representing each of the sensor nodes of FIG. 1A.

FIG. 2 is a simplified block diagram of a sensor node Sn representing each of the sensor nodes S1, S2, S3, and S4 of the wellbore sensor system 100 of FIG. 1A. The sensor node Sn may include one or more sensors 200 (hereinafter "sensors" 200). The sensors 200 may include at least one spatial sensor 210 (sometimes referred to herein as "spatial sensor" 210). By way of non-limiting example, the spatial sensor 210 may include an accelerometer 212, a magnetometer 214, a gyroscope 216, other spatial sensors, or combinations thereof. In some embodiments, the sensors 200 may also include other sensors 220. By way of non-limiting example, the other sensors 220 may include a pressure sensor, a temperature sensor, an elevation sensor, an acoustic sensor, an electromagnetic sensor, other sensors, or combinations thereof.

Each of the sensors 200 may be configured to provide sensor data 202 indicating sensor readings. As the sensors 200 include at least one spatial sensor 210, the sensor data 202 may include at least spatial sensor data from the at least one spatial sensor 210. The sensor node Sn may be configured to transmit the sensor data 202 through the wellbore communication system 150 (FIG. 1A).

The sensor node Sn may also include a time keeping module 240 configured to keep track of time. By way of non-limiting example, the time keeping module 240 may include at least an oscillator and a counter configured to keep track of time. The sensor node Sn may be configured to associate sensor readings from the sensors 200 with a time at which the sensor readings were taken, and include information indicating the time at which the sensor readings were taken in the sensor data 202. By way of non-limiting example, the sensor data 202 may include an array that includes readings taken by the sensors, and the corresponding time at which the readings were taken. The time keeping module 240 may be configured to receive a time signal 312 configured to synchronize the time of the time keeping module 240 with the time of the time keeping modules 240 of the others of the sensor nodes S1, S2, S3, and S4 (FIG. 1A). In this way, the sensor node Sn may be synchronized with each of the others of the sensor nodes S1, S2, S3, and S4 in time.

In some embodiments, one or more of the sensor nodes S1, S2, S3, and S4 (FIG. 1A) may include control circuitry 300 configured to generate mathematical transforms to transform sensor data 204 from others of the sensor nodes S1, S2, S3, and S4 into a common spatial frame of reference. In such embodiments, the sensor nodes Sn that generate the mathematical transforms may be configured to receive the sensor data 204 from the others of the sensor nodes S1, S2, S3, and S4 through the wellbore communication system 150 (FIG. 1A), as well as the sensor data 202 from the sensors 200. Accordingly, the control circuitry 300 may be configured to receive sensor data 302 including both the sensor data 202 and the sensor data 204. The control circuitry 300 may be configured to collect the sensor data 202 during prescribed motion, use the sensor data 302 to generate the mathematical transforms, and apply the mathematical transforms to the sensor data 302 to transform the sensor data 302 into a common spatial frame of reference.

Figure 3:
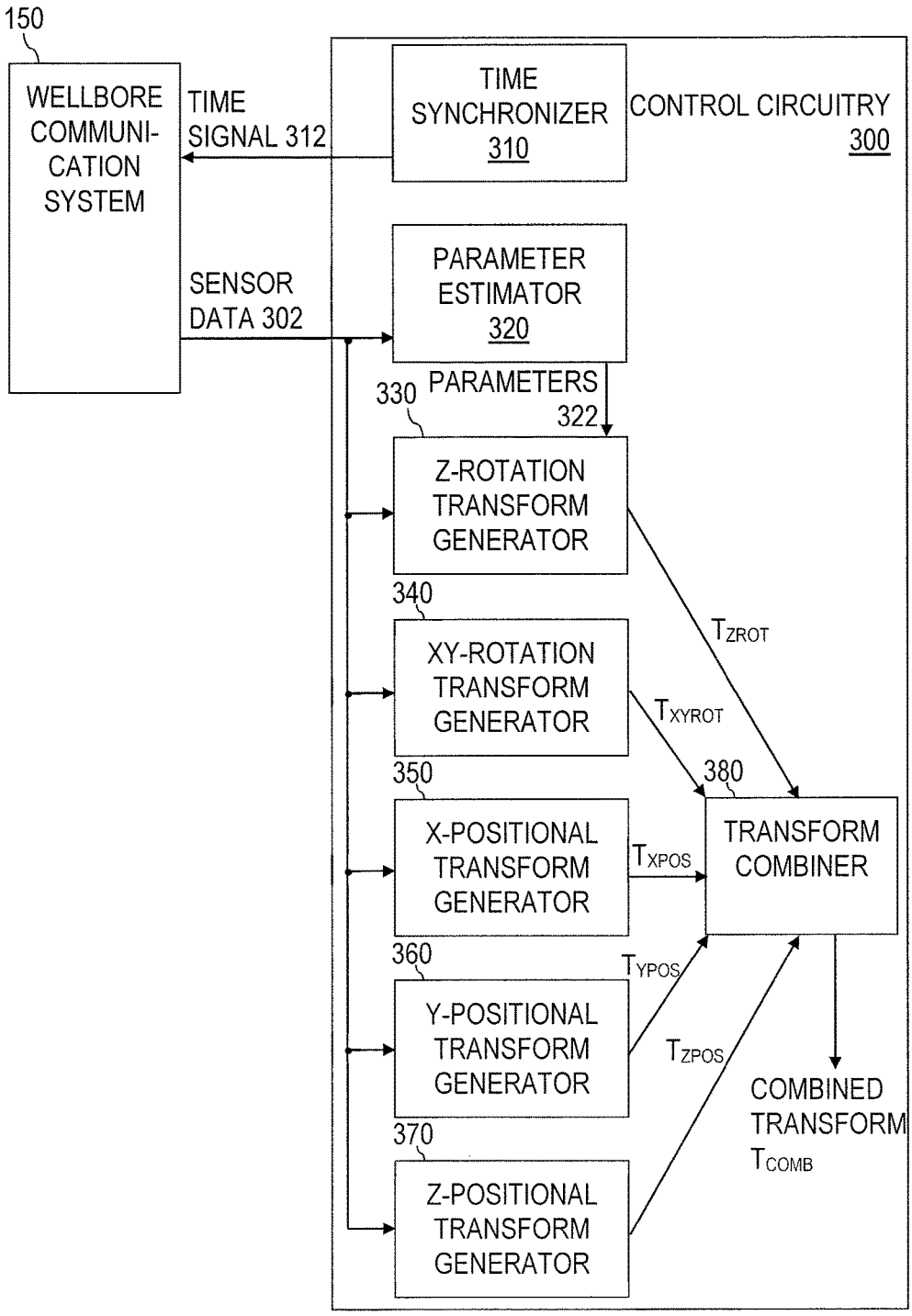
FIG. 3 is a simplified block diagram of control circuitry that may be used to generate and apply mathematical transforms to sensor data from the sensor nodes of FIG. 1A.

FIG. 3 is a simplified block diagram of control circuitry 300 that may be used to generate and apply mathematical transforms to sensor data 302 from the sensors S1, S2, S3, and S4 of FIG. 1A. The control circuitry 300 may be operably coupled to the wellbore communication system 150, and be configured to transmit and receive communications through the wellbore communication system 150. For example, the control circuitry 300 may be configured to receive sensor data 302 and transmit a time signal 312 through the wellbore communication system 150.

The control circuitry 300 may be configured to generate a combined transform $T_{COMB}$ that may be used to transform the sensor data 302 from each of the sensor nodes S1, S2, S3, and S4 into a common spatial frame of reference. The control circuitry 300 may also be configured to synchronize the time keeping module 240 (FIG. 2) of each sensor node S1, S2, S3, and S4 (FIG. 1A) to a common time. In this way, the control circuitry 300 may be capable of digitally aligning the sensor data 302 from each of the sensor nodes S1, S2, S3, and S4 in both space and time.

As previously discussed, in some embodiments, the control circuitry 300 may be included in one of the sensor nodes S1, S2, S3, and S4. It is also contemplated herein that more than one of the sensor nodes S1, S2, S3, and S4 may include control circuitry 300, and the functions that the control circuitry 300 is configured to perform may be distributed among the control circuitry 300 of the various sensor nodes S1, S2, S3, and S4. In some embodiments, the control circuitry 300 may be included in the surface equipment 120 (FIG. 1A). Also, the functions of the control circuitry 300 may be distributed among control circuitry included in the surface equipment 120, and in one or more of the sensor nodes S1, S2, S3, and S4. In some embodiments, the control circuitry 300 may be a separate device (not shown) that is not included in any of the surface equipment 120 and the sensor nodes S1, S2, S3, and S4. In some embodiments, the control circuitry 300 may be distributed between the separate device, and one or more of the surface equipment 120 and the sensor nodes S1, S2, S3, and S4. Distributed control circuitry 300 may use the wellbore communication system 150 to transmit and receive data between the various distributed elements of the control circuitry 300.

The control circuitry 300 may include a time synchronizer 310 configured to transmit the time signal 312 to each of the sensor nodes S1, S2, S3, and S4, and to instruct the sensor nodes S1, S2, S3, and S4 to synchronize their time to a common time. By way of non-limiting example, the time signal 312 may simply indicate a common time, and the sensor nodes S1, S2, S3, and S4 may each synchronize their time keeping modules 240 to the time indicated by the time signal 312. In some embodiments, the time synchronizer 310 may be configured to periodically re-synchronize the time. By way of non-limiting examples, the time synchronizer 310 may be configured to re-synchronize the time every 90 feet of drill string 130 (FIG. 1A) extended into the wellbore 114 (FIG. 1A), every time the wellbore sensor system 100 (FIG. 1A) shuts down and re-starts, at predetermined time intervals, or combinations thereof.

The control circuitry 300 may also include a parameter estimator 320 configured to determine parameters 322 of each of the different sensor nodes S1, S2, S3, and S4 from the sensor data 302. In some embodiments, the parameter estimator 320 may be configured to estimate a rotational frequency $\omega_{SnMAG}$ (e.g., in revolutions per second) of each of the different sensor nodes S1, S2, S3, and S4 by analyzing (e.g., using autocorrelation, spectral analysis, etc.) spatial sensor data (e.g., magnetometer data, where a z-axis is parallel to the drill string 130 of FIG. 1A) of the sensor data 302. Also, the parameter estimator 320 may use the estimated rotational frequency $\omega_{SnMAG}$ to compute a numeric regression (e.g., a cosinor regression, a nonlinear regression, etc.) on the spatial sensor data (e.g., magnetometer data) to determine parameters 322 including an offset $m_{SnMAG}$, an amplitude $a_{SnMAG}$, and a phase angle $\varphi_{SnMAG}$ of the spatial sensor data (e.g., the magnetometer data) for each of the sensor nodes S1, S2, S3, and S4. By way of non-limiting example, the parameter estimator 320 may be configured to estimate the rotational frequency $\omega_{nSnMAG}$ while the drill string 130 (FIG. 1A) is being driven at about 10 revolutions per minute. If it is known how fast the drill string 130 is being driven, a confidence level of the accuracy of the estimate of $\omega_{SnMAG}$ may be determined. If the estimate of $\omega_{SnMAG}$ is within about a 95% confidence level, the parameter estimator 320 may estimate the parameters 322. If, however, the confidence level is less than 95%, the estimate of $\omega_{SnMAG}$ may be refined before estimating the parameters 322.

The subscript "nSnMAG" indicates that one or more components of the magnetometer data was or is to be used to determine the rotational frequency $\omega_{nSnMAG}$ of sensor node "Sn," and that a regression was or is to be performed on magnetometer "MAG" data of sensor node "Sn." Accordingly, the subscript "S1MAG" would indicate that one or more of the components of the magnetometer data of sensor node S1 was or is to be used to determine the rotational frequency $\omega_{S1MAG}$ of sensor node S1, and that a regression was or is to be performed on magnetometer data of sensor node S1. The parameter estimator 320 may, for example, use the following expression for the numeric regressions:

$$M_{SnMAG}(t_i)=m_{SnMAG}+a_{SnMAG}\sin(2\pi\omega_{SnMAG}t_i+\varphi_{SnMAG}),$$

where $M_{SnMAG}(t_i)$ is the time varying magnetometer data of sensor node Sn. Accordingly, the parameter estimator 320 may estimate parameters including the rotational frequency $\omega_{nSnMAG}$, the offset $m_{SnMAG}$, the amplitude $a_{SnMAG}$, and phase $\varphi_{SnMAG}$ for each of the sensor nodes S1, S2, S3, and S4.

The control circuitry 300 may also include several transform generators 330, 340, 350, 360, and 370 configured to use at least one of the sensor data 302 and the parameters 322 from the parameter estimator 320 to generate transforms for each of the sensor nodes S1, S2, S3, and S4. Each of these transform generators 330, 340, 350, 360, and 370 may be configured to generate mathematical transforms that represent relative rotations and translations between the spatial frames of reference of the sensor nodes S1, S2, S3, and S4 and a desired common spatial frame of reference for different rotational and positional degrees of freedom.

For example, a Z-rotation transform generator 330 may be configured to generate a Z-rotation transform $T_{ZROT}$ configured to rotationally align z-axes of spatial frames of reference for each of the sensor nodes S1, S2, S3, and S4 with a z-axis of the common spatial frame of reference. Specifically, the Z-rotation transform generator 330 may be configured to compare phase $\varphi_{SnMAG}$ parameters 322 from each of the sensor nodes S1, S2, S3, and S4 to a phase parameter $\varphi_{SnMAG}$ of the common spatial frame of reference. By way of non-limiting example, sensor node S1 may be selected to be a master sensor node, and a first spatial frame of reference corresponding thereto may be selected to be the common spatial frame of reference. The Z-rotation transform $T_{ZROT}$ for each of the other sensor nodes S2, S3, and S4 may be computed by:

$${}^{S1}T_{ZROT_SnN}=\varphi_{S1\times MAG}-\varphi_{SnN\times MAG}.$$

Accordingly, the Z-rotation transform $T_{ZROT}$ for sensor node S3 may be computed as:

$${}^{S1}T_{ZROT_SnN}=\varphi_{S1\times MAG}-\varphi_{S3\times MAG}.$$

Data corresponding to the Z-rotation transforms $T_{ZROT}$ for each one of the sensor nodes S1, S2, S3, and S4, other than any master sensor node, may be written to a storage device 520 (FIG. 5) of the control circuitry 300.

An XY-rotation transform generator 340 may be configured to generate an XY-rotation transform $T_{XYROT}$ configured to rotationally align the x- and y-axes of the spatial frames of reference for each of the sensor nodes S1, S2, S3, and S4 with an x-axis and a y-axis of the common spatial frame of reference. In some embodiments, the XY-rotation transform generator 340 may be configured to use a normal, orientation, approach (NOA) computation to align the x- and y-axes of the spatial frames of reference for each of the sensor nodes S1, S2, S3, and S4 with the x-axis and the y-axis of the common spatial frame of reference. Specifically, the XY-rotation transform generator 340 may be configured to solve for a single vector $K_{Sn}$ for each of the sensor nodes S1, S2, S3, and S4 that if the corresponding spatial frame of reference is rotated about by ${}_n\theta_{Sn}$ degrees, the corresponding x- and y-axes will align with the x- and y-axes of the common spatial frame of reference. The solution for $K_{Sn}$ and ${}_n\theta_{Sn}$ may be obtained by solving for $\{K_{SnX}, K_{SnY}, \theta_{Sn}\}$ based on static data and:

$$\{K_{SnY}\times\mathrm{Sin}(\theta_{Sn}), -K_{SnX}\times\mathrm{Sin}(\theta_{SN}), \mathrm{Cos}(\theta_{Sn})\} = \{N_{S1Z}, O_{S1Z}, A_{S1Z}\},$$

where $N_{S1Z}$, $O_{S1Z}$, and $A_{S1Z}$ are normal, orientation, and approach vectors. The solution for the XY-rotation transform $T_{XYROT}$ may be computed by:

$$\begin{matrix} K_{SnX} \\ K_{SnY} \\ 0 \\ \theta_{Sn} \end{matrix} = \begin{matrix} K_{SnX}^2(1-\mathrm{Cos}\theta_{Sn}) + \mathrm{Cos}\theta_{Sn} & K_{SnX}K_{SnY}(1-\mathrm{Cos}\theta_{Sn}) & K_Y\mathrm{Sin}\theta_{Sn} & 0 \\ K_{SnX}K_{SnY}(1-\mathrm{Cos}\theta) & K_Y^2(1-\mathrm{Cos}\theta_{Sn}) + \mathrm{Cos}\theta_{Sn} & -K_X\mathrm{Sin}\theta_{Sn} & 0 \\ K_Y\mathrm{Sin}\theta_{Sn} & -K_X\mathrm{Sin}\theta_{Sn} & \mathrm{Cos}\theta_{Sn} & 0 \\ 0 & 0 & 0 & 1 \end{matrix}$$

where $K_{SnY}$ Sin $\theta_{Sn}=N_{S1Z}$, $-K_{SnX}$ Sin $\theta_{Sn}=O_{S1Z}$, and Cos $\theta_{Sn}=A_{S1Z}$.

Figure 5:
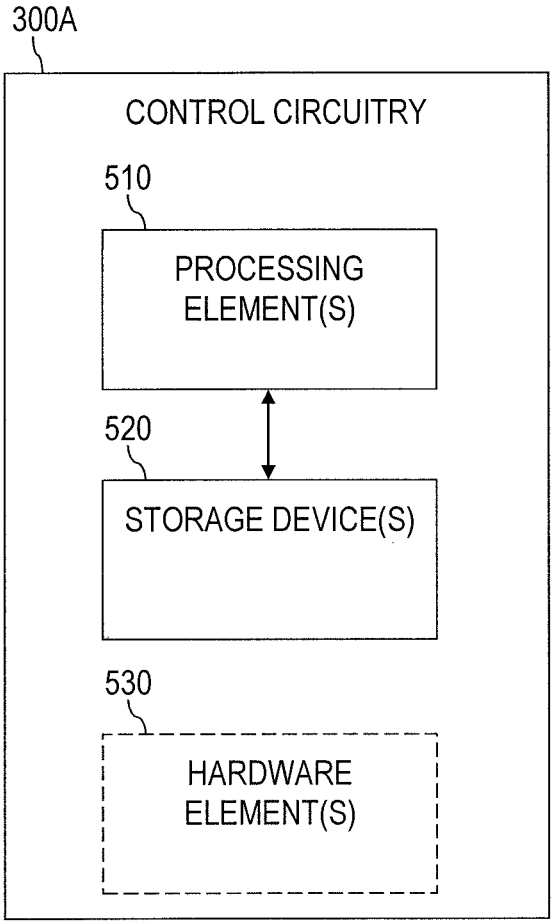
FIG. 5 is a simplified block diagram of an example of control circuitry that may be used to implement control circuitry of FIG. 3.

An X-positional transform generator 350 may be configured to generate an X-positional transform $T_{SnXTran}$ configured to translate positions of vertices of the spatial frames of reference of the sensor nodes S1, S2, S3, and S4 to an x=0 coordinate of the common spatial frame of reference. In other words, the X-positional transform generator 350 may be configured to generate an X-positional transform $T_{SnXTran}$ configured to correct for differences in an X-positional degree of freedom in sensor data 302 from each of the sensor nodes S1, S2, S3, and S4. In some embodiments, the rotation of the drill string 130 (FIG. 1A) may be accelerated to 60 revolutions per minute, and new values for $\omega_{SnMAG}$ may be estimated and written to the storage device 520 (FIG. 5). The X-positional transform generator 350 may then use the new values for $\omega_{SnMAG}$ to compute the X-positional transform $T_{SnXTran}$ for each of the sensor nodes S1, S2, S3, and S4. By way of non-limiting example, if sensor node S1 is selected to be the master reference node (i.e., a spatial frame of reference of sensor node S1 is the common spatial frame of reference), the X-positional transform $T_{SnXTran}$ may be computed by solving the expression:

$$p_{Snx} = \frac{(\mathrm{accel}_{S1x} - \mathrm{accel}_{Snx})}{(2\pi\omega_{SnxMAG})}$$

where $p_{SNx}$ is the difference in radii along the X axis between the radial accelerometers of sensor nodes S1 and Sn, and $\mathrm{accel}_{Snx}$ is measured acceleration of an x-component of acceleration data from the accelerometer. The solution for the X-positional transform $T_{SnXTran}$ may be computed by:

$$T_{SnXTran} = \begin{matrix} 1 & 0 & 0 & p_{Snx} \\ 0 & 1 & 0 & 0 \\ 0 & 0 & 1 & 0 \\ 0 & 0 & 0 & 1 \end{matrix}$$

data corresponding to the X-positional transform $T_{SnXTran}$ may be written to the storage device 520 (FIG. 5).

Similarly, a Y-positional transform generator 360 may be configured to generate a Y-positional transform $T_{SnYTran}$ configured to correct for a Y-positional degree of freedom of sensor data 302 with respect to the common spatial frame of reference for each of the sensor nodes S1, S2, S3, and S4. In some embodiments, the rotation of the drill string 130 (FIG. 1A) may be accelerated to 120 revolutions per minute, and an average angular acceleration avg_α may be computed and stored in the storage device 520 for each sensor node S1, S2, S3, and S4. The Y-positional transform generator 360 may then use the stored 60 revolutions per minute values for $\omega_{SnMAG}$ to compute the Y-positional transform $T_{SnYTran}$ for each of the sensor nodes S1, S2, S3, and S4. By way of non-limiting example, if sensor node S1 is selected to be the master reference node (i.e., a spatial frame of reference of sensor node S1 is the common spatial frame of reference), the Y-positional transform $T_{SnYTran}$ may be computed by solving the expression:

$${}_np_{Sny} = \frac{(\mathrm{accel}_{S1y} - \mathrm{accel}_{Sny})}{(2\pi\omega_{SnxMAG})}$$

where $p_{Sny}$ is the transverse distance along the Y-axis between the tangential accelerometers of sensor nodes S1 and Sn, and $\mathrm{accel}_{Sny}$ is measured acceleration of a y-component of acceleration data from the accelerometer. The solution for the Y-positional transform $T_{SnYTran}$ may be computed by:

$$T_{SnYTran} = \begin{matrix} 1 & 0 & 0 & 0 \\ 0 & 1 & 0 & p_{Sny} \\ 0 & 0 & 1 & 0 \\ 0 & 0 & 0 & 1 \end{matrix}$$

data corresponding to the Y-positional transform $T_{SnYTran}$ may be written to the storage device 520 (FIG. 5).

Moreover, a Z-positional transform generator 370 may be configured to generate a Z-positional transform $T_{SnZTran}$ configured to correct for a Z-positional degree of freedom of sensor data 302 with respect to the common spatial frame of reference for each of the sensor nodes S1, S2, S3, and S4. In some embodiments, a shock wave may be induced on the drill string 130 (FIG. 1A) (e.g., by impacting the drill string 130 at the surface 112 (FIG. 1A)), and a time $T_{SnTRAN}$ required for the shock wave to reach each of the sensor nodes S1, S2, S3, and S4 may be detected and stored in the storage device 520 (FIG. 5). The sense nodes S1, S2, S3, and S4 may detect the shock wave using their spatial sensors 210 (FIG. 2). The Z-positional transform generator 370 may then use the stored times $T_{SnZTran}$, together with a known velocity (e.g., empirically obtained, calculated based on known material parameters of the drill string, etc.) of shock waves along the length of the drill string 130, to compute the Z-positional transform $T_{SnZTran}$ for each of the sensor nodes S1, S2, S3, and S4. Specifically, kinematic expressions relating distance to velocity and time (i.e., distance=velocity×time) may enable computation of spatial distances between the sensor nodes S1, S2, S3, and S4 based on how much time it takes for the shock wave to reach each of the sensor nodes S1, S2, S3, and S4. By way of non-limiting example, if sensor node S1 is selected to be the master reference node (i.e., a spatial frame of reference of sensor node S1 is the common spatial frame of reference), the Z-positional transform $T_{SnZTran}$ may be computed by solving the expression:

$$P_{Snz}=V_{SW}t_{SnZ},$$

wherein $p_{Snz}$ is the spatial distance between the master sense node S1 and sense node Sn, $V_{SW}$ is the known velocity of the shockwave along the drill string 130, and $t_{Sn}$ is a difference between the time required for the shock wave to reach the master sense node S1 and the time it took to reach sense node Sn. The Z-Positional transform generator 370 may generate the Z-positional transform $T_{SnZTran}$ from the computed $p_{Snz}$, and store data corresponding to $T_{SnZTran}$ in the storage device 520 (FIG. 5).

Once transforms accounting for each of three rotational degrees of freedom (e.g., the Z-rotation $T_{ZROT}$ transform and the XY-rotation transform $T_{XYROT}$) and each of three positional degrees of freedom (e.g., the X~, Y~, and Z-positional transforms $T_{SnXTran}$, $T_{SnYTran}$, and $T_{SnZTran}$) are obtained, the control circuitry 300 may combine the transforms $T_{ZROT}$, $T_{XYROT}$, $T_{SnXTran}$, $T_{SnYTran}$, and $T_{SnZTran}$ into a single combined transform $T_{COMB}$ for each of the different sensor nodes S1, S2, S3, and S4 (i.e., a different combined transform $T_{COMB}$ for each of the different sensor nodes S1, S2, S3, and S4 is generated). The control circuitry 300 may include a transform combiner 380 configured to combine each of the transforms $T_{ZROT}$, $T_{XYROT}$, $T_{SnXTran}$, $T_{SnYTran}$, and $T_{SnZTran}$ to generate the combined transform $T_{COMB}$.

In some embodiments, each of the transforms $T_{ZROT}$, $T_{XYROT}$, $T_{SnXTran}$, $T_{SnYTran}$, and $T_{SnZTran}$ may be a homogenous transform. By way of non-limiting example, each of the transforms $T_{ZROT}$, $T_{XYROT}$, $T_{SnXTran}$, $T_{SnYTran}$, and $T_{SnZTran}$ may include a four-by-four matrix with the first three columns directed to transforming the three rotational degrees of freedom x, y, and z, and a fourth column directed to transforming the three positional degrees of freedom. In such embodiments, the transform combiner 380 may be configured to perform a matrix multiplication of each of the transforms $T_{ZROT}$, $T_{XYROT}$, $T_{SnZTran}$, $T_{SnYTran}$, and $T_{SnZTran}$ to obtain the combined transform $T_{COMB}$·$T_{SnXTran}$·$T_{SnYTran}$·$T_{SnZTran}$).

Once the control circuitry 300 has generated a combined transform $T_{COMB}$ for each of the sensor nodes S1, S2, S3, and S4 (other than a master sensor node that may have been selected to be a reference for the common spatial frame of reference), the control circuitry 300 may apply the combined transforms $T_{COMB}$ to the sensor data 302 to transform the sensor data 302 into a single common spatial frame of reference. It is also contemplated, however, that each of the transforms $T_{ZROT}$, $T_{XYROT}$, $T_{SnXTran}$, $T_{SnYTran}$, and $T_{SnZTran}$ may be applied to the sensor data 302 separately. Since each of the transforms each of the transforms $T_{ZROT}$, $T_{XYROT}$, $T_{SnXTran}$, $T_{SnYTran}$, and $T_{SnZTran}$ is homogenous, separate application should yield the same results as combined application.

The combined transforms $T_{COMB}$ for each of the sensor nodes S1, S2, S3, and S4 may facilitate the computation of mathematical transforms that transform sensor data 302 from any of the sensor nodes S1, S2, S3, and S4, to spatial frames of reference of any of the others of the sensor nodes S1, S2, S3, and S4. By way of non-limiting example, where the combined transforms $T_{COMB}$ were computed based on a sensor node S1 being a master sensor node, a mathematical transform configured to transform sensor data 302 from sensor node S2 to a spatial frame of reference of S4 may be readily computed using the combined transforms $T_{COMB}$ for each of sensor nodes S2 and S4. More specifically, the transform for S4 relative to S2, for example, may be calculated by pre-multiplying the transform for S4 relative to S1 by the inverse of the transform for S2 relative to S2.

Figure 4:
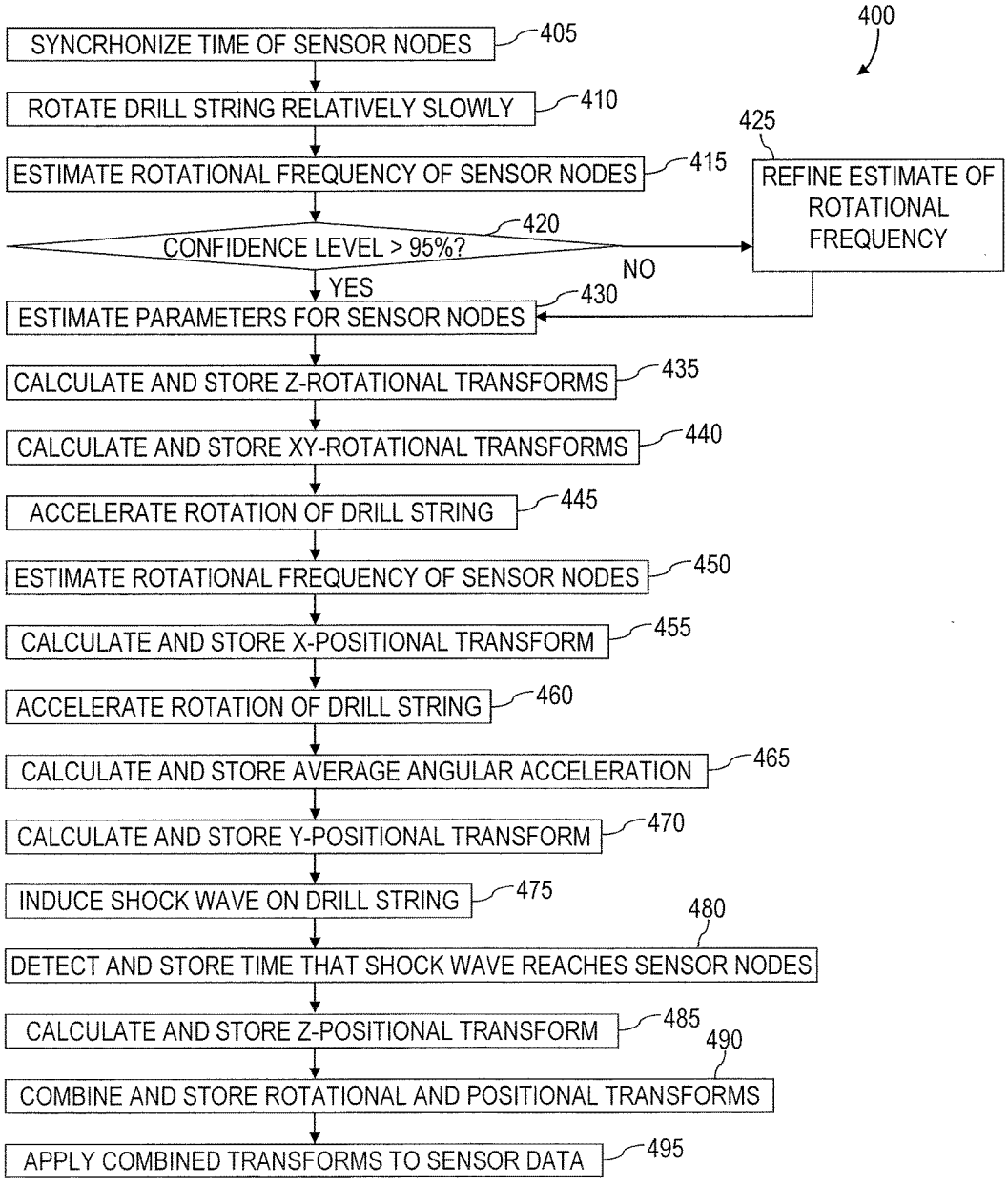
FIG. 4 is a simplified flowchart illustrating a method of operating the wellbore sensor system of FIG. 1A.

FIG. 4 is a simplified flowchart 400 illustrating a method of operating the wellbore sensor system 100 of FIG. 1A. Referring to FIGS. 1A, 2, 3, and 4 together, at operation 405 the method may include synchronizing the time of each of the sensor nodes S1, S2, S3, and S4. In some embodiments, synchronizing the time may include transmitting a time signal 312 to each of the sensor nodes S1, S2, S3, and S4 through the wellbore communication system 150.

At operation 410, the method may include rotating the drill string 130 relatively slowly at a known, at least substantially constant rate of rotation. By way of non-limiting example, the surface equipment 120 may be manipulated to cause the drill string 130 to rotate at about 10 revolutions per minute (RPMs), about 20 RPMs or another slow, known, at least substantially constant rate of rotation.

At operation 415, the method may include estimating rotational frequency $\omega_{SnMAG}$ of each of the sensor nodes S1, S2, S3, and S4 using the sensor data 302. By way of non-limiting example, the parameter estimator 320 may use one or more of accelerometer data and magnetometer data to estimate the rotational frequency $\omega_{SnMAG}$.

At operation 420, the method may include determining whether the estimated rotational frequency $\omega_{SnMAG}$ for each of the sensor nodes S1, S2, S3, and S4 is accurate within a 95% confidence level. By way of non-limiting example, the estimated rotational frequency $\omega_{SnMAG}$ for each of the sensor nodes S1, S2, S3, and S4 may be compared against a known rotational frequency of the drill string 130. If the estimated rotational frequency $\omega_{SnMAG}$ is not within the 95% confidence level, at operation 425, the method may include refining the estimate of the rotational frequency $\omega_{SnMAG}$. By way of non-limiting example, the parameter estimator 320 may refine the estimate of the rotational frequency $\omega_{SnMAG}$ by analyzing new sensor data 302 received from the sensors S1, S2, S3, and S4 through the wellbore communication system 150.

Returning to operation 420, if the estimated rotational frequency $\omega_{SnMAG}$ is within the 95% confidence level, at operation 430 the method may include estimating parameters 322 for the sensor nodes S1, S2, S3, and S4. By way of non-limiting example, the parameter estimator 320 may estimate parameters 322 including a bias $m_{SnMAG}$, an amplitude $a_{SnMAG}$, and a phase $\varphi_{SnMAG}$ of the spatial sensor data (e.g., the magnetometer data). In some embodiments, estimating the parameters 322 may include performing a numeric regression (e.g., a cosinor regression, a nonlinear regression, etc.) on magnetometer data measured by a magnetometer 214 (FIG. 2) of each of the sensor nodes S1, S2, S3, and S4.

At operation 435, the method may include calculating and storing a Z-rotational transform $T_{ZROT}$ for each of the sensor nodes S1, S2, S3, and S4 relative to a common spatial frame of reference. In some embodiments, calculating a Z-rotational transform $T_{ZROT}$ may include using information from the parameters 322 (e.g., the phase $\varphi_{SnMAG}$ data) to calculate the Z-rotational transform $T_{ZROT}$. By way of non-limiting example, the Z-rotational transform $T_{ZROT}$ for each sensor node S1, S2, S3, and S4 may be calculated by comparing the phase $\varphi_{SnMAG}$ to a phase of the common spatial frame of reference. In some embodiments, calculating a Z-rotational transform $T_{ZROT}$ may include solving for the transform $T_{ZROT}$ that aligns a z-axis of the corresponding sensor node S1, S2, S3, and S4 with a z-axis of the common spatial frame of reference. In some embodiments, storing the Z-rotational transform $T_{ZROT}$ may include storing the Z-rotational transform $T_{ZROT}$ to a storage device 520 (FIG. 5).

At operation 440, the method may include calculating and storing an XY-rotational transform $T_{XYROT}$ for each of the sensor nodes S1, S2, S3, and S4 relative to the common spatial frame of reference. In some embodiments, calculating an XY-rotational transform $T_{XYROT}$ may include determining K-vectors about which each spatial frame of reference of each of the sensor nodes S1, S2, S3, and S4 may be rotated by angles $\theta_{Sn}$ to align the x-axes and y-axes of the spatial frames of reference of the sensor nodes S1, S2, S3, and S4 with the x-axis and the y-axis of the common spatial frame of reference.

At operation 445, the method may include accelerating rotation of the drill string 130 to an intermediate known, at least substantially constant rate of rotation. By way of non-limiting example, accelerating rotation of the drill string 130 may include accelerating rotation of the drill string 130 to about 60 RPMs, about 75 RPMs or another intermediate, known, at least substantially constant rate of rotation. Tangential acceleration (i.e., angular acceleration) of a given sensor node Sn may be calculated by obtaining the product of the distance from the center of rotation to the tangential accelerometer and the first derivative of the angular velocity.

At operation 450, the method may include estimating rotational frequency of each of the sensor nodes S1, S2, S3, and S4. In some embodiments, estimating the rotational frequency may be performed similarly as discussed with reference to operations 415, 420, and 425. In some embodiments, estimating rotational frequency of the sensor nodes S1, S2, S3, and S4 may include storing the estimated rotational frequencies to storage device 520 (FIG. 5).

At operation 455, the method may include calculating and storing an X-positional transform $T_{SnXTran}$ for each of the plurality of sensor nodes S1, S2, S3, and S4. In some embodiments, calculating an X-position transform may include comparing accelerometer data (e.g., x-axis components) from accelerometers 212 (FIG. 2) of the sensor nodes S1, S2, S3, and S4 to determine positional offsets in the x-directions of the sensor nodes S1, S2, S3, and S4 between the sensor nodes S1, S2, S3, and S4 and the common spatial frame of reference. In some embodiments, storing an X-positional transform $T_{SnXTran}$ may include storing data corresponding to the X-positional transform $T_{SnXTran}$ to the storage device 520 (FIG. 5).

At operation 460, the method may include accelerating rotation of the drill string 130 further to a fast, known, at least substantially constant rate of rotation. By way of non-limiting example, accelerating rotation of the drill string 130 may include accelerating rotation of the drill string to about 120 RPMs, about 150 RPMs or another fast, known, at least substantially constant rate of rotation.

At operation 465, the method may include calculating and storing an average angular acceleration avg_α of each of the sensor nodes S1, S2, S3, and S4. In some embodiments, calculating an average angular acceleration avg_α may include calculating average angular accelerations avg_α based on accelerometer data from accelerometers 212 of the sensor nodes S1, S2, S3, and S4 while rotating the drill string 130 at 120 RPMs. In some embodiments, storing an average angular acceleration avg_α may include storing data corresponding to the average angular acceleration avg_α to the storage device 520 (FIG. 5)

At operation 470, the method may include calculating and storing a Y-positional transform $T_{SnYTran}$ for each of the plurality of sensor nodes S1, S2, S3, and S4. In some embodiments, calculating a Y-position transform $T_{SnYTran}$ may include comparing accelerometer data (e.g., y-axis components) from accelerometers 212 (FIG. 2) of the sensor nodes S1, S2, S3, and S4 to determine positional offsets in the y-directions of the sensor nodes S1, S2, S3, and S4 between the sensor nodes S1, S2, S3, and S4 and the common spatial frame of reference. In some embodiments, storing a Y-positional transform $T_{SnYTran}$ may include storing data corresponding to the Y-positional transform $T_{SnYTran}$ to the storage device 520 (FIG. 5).

At operation 475, the method may include inducing a shock wave on the drill string 130. Inducing a shock wave on the drill string 130 may include striking, at the surface 112 of the formation 110, the drill string 130 with an object (e.g., a hammer, etc.).

At operation 480, the method may include detecting and storing a time at which the shock wave reaches each one of the sensor nodes S1, S2, S3, and S4. In some embodiments, detecting and storing a time at which the shock wave reaches each one of the sensor nodes S1, S2, S3, and S4 may include storing data corresponding to the time that the spatial sensor 210 of each one of the sensor nodes S1, S2, S3, and S4 registers a stimulus consistent with the shock wave to the storage device 520 (FIG. 5).

At operation 485, the method may include calculating and storing a Z-positional transform $T_{SnZTran}$ for each of the sensor nodes S1, S2, S3, and S4. In some embodiments, calculating a Z-positional transform $T_{SnZTran}$ for each of the sensor nodes S1, S2, S3, and S4 may include calculating a difference between the stored time that the shock wave reached the sensor nodes S1, S2, S3, and S4 to a time at which the shock wave reached a vertex of the common spatial frame of reference, and using a kinematic relationship between velocity of the shock wave, the difference in time, and distance to compute the distance. In some embodiments, storing the Z-positional transform $T_{SnZTran}$ may include storing data corresponding to the Z-positional transform $T_{SnZTran}$ to the storage device 520.

At operation 490, the method may include combining rotational and positional transforms $T_{ZROT}$, $T_{XYROT}$, $T_{SnXTran}$, $T_{SnYTran}$, and $T_{SnZTran}$ into a single combined transform $T_{COMB}$, and storing data corresponding to the combined transform $T_{COMB}$, for each one of the sensor nodes S1, S2, S3, and S4. In some embodiments, combining the rotational and positional transforms $T_{ZROT}$, $T_{XYROT}$, $T_{SnXTran}$, $T_{SnYTran}$, and $T_{SnZTran}$ into a single combined transform $T_{COMB}$ may include computing a cross product of each of the rotational and positional transforms $T_{ZROT}$, $T_{XYROT}$, $T_{SnXTran}$, $T_{SnYTran}$, and $T_{SnZTran}$. In some embodiments, combining the rotational and positional transforms $T_{ZROT}$, $T_{XYROT}$, $T_{SnXTran}$, $T_{SnYTran}$, and $T_{SnZTran}$ into a single combined transform $T_{COMB}$ may include computing a dot product of each of the rotational and positional transforms $T_{ZROT}$, $T_{XYROT}$, $T_{SnXTran}$, $T_{SnYTran}$, and $T_{SnZTran}$. In some embodiments, storing data corresponding to the combined transform $T_{COMB}$ may include storing the data corresponding to the combined transform $T_{COMB}$ to the storage device 520 (FIG. 5).

At operation 495, the method may include applying the combined transforms to the sensor data 302 to transform the sensor data into the single common spatial frame of reference.

FIG. 5 is a simplified block diagram of an example of control circuitry 300A that may be used to implement the control circuitry 300 of FIG. 3. The control circuitry 300A may include one or more processing elements 510 (hereinafter "processing elements" 510) operably coupled to one or more memory/storage devices 520 (hereinafter "storage devices" 520). The storage devices 520 may be configured to store computer-readable instructions configured to instruct the processing elements 510 to perform at least a portion of the functions the control circuitry 300 is configured to perform. By way of non-limiting example, the computer-readable instructions may be configured to instruct the processing elements 510 to perform the functions of at least one of the time synchronizer 310, the parameter estimator 320, the Z-rotation transform generator 330, the XY-rotation transform generator 340, the X-positional transform generator 350, the Y-positional transform generator 360, the Z-positional transform generator 370, and the transform combiner 380, discussed above with reference to FIG. 3. Also by way of non-limiting example, the computer-readable instructions may be configured to instruct the processing elements 510 to perform at least a portion of the method illustrated by the flowchart 400 of FIG. 4.

The storage devices 520 may include random access memory (e.g., dynamic random access memory (DRAM), static random access memory (SRAM), etc.), read only memory (e.g., electrically programmable read only memory (EPROM), Flash memory, etc.), portable media readers (e.g., compact disc (CD) readers, digital versatile disc (DVD) readers, portable secure digital (SD) card readers, compact flash card readers, etc.), other memory and storage devices, and combinations thereof. In some embodiments, the storage devices 520 may be configured to permanently store the computer-readable instructions. In some embodiments, the storage devices 520 may be configured to temporarily store the computer-readable instructions. By way of non-limiting example, the computer-readable instructions may be stored on a non-volatile data storage device of the memory storage devices 520, and transferred to a volatile memory device of the storage devices 520 for execution by the processing elements 510.

Also, data (e.g., sensor data 302, parameters 320, rotational frequency $\omega_{SnMAG}$ data, data corresponding to transforms $T_{ZROT}$, $T_{XYROT}$, $T_{SnXTran}$, $T_{SnYTran}$, $T_{SnZTran}$, and $T_{COMB}$, data corresponding to average angular accelerations avg_α, data corresponding to times at which the shock wave reaches the sensor nodes S1, S2, S3, and S4, and other data) may be stored by the storage devices 520 during processing thereof and otherwise.

The processing elements 510 may include a microcontroller, a central processing unit (CPU), a programmable logic controller (PLC), other processing circuits, and combinations thereof. The processing elements 510 may be configured to execute the computer-readable instructions stored in the storage devices 520. Accordingly, the computer-readable instructions transform the processing elements 510 and the storage devices 520 from a general-purpose computer into a special purpose computer configured to carry out embodiments of the disclosure.

In some embodiments, the control circuitry 300A may include one or more hardware elements 530 (hereinafter "hardware elements" 530). The hardware elements 530 may be configured to perform at least some of the functions the control circuitry 300 (FIG. 3) is configured to perform. By way of non-limiting example, the hardware elements 530 may include hardware implementations of one or more of the time synchronizer 310, the parameter estimator 320, the Z-rotation transform generator 330, the XY-rotation transform generator 340, the X-positional transform generator 350, the Y-positional transform generator 360, the Z-positional transform generator 370, and the transform combiner 380 discussed above with reference to FIG. 3.

By way of non-limiting example, the hardware elements 530 may include a field programmable gate array, an application specific integrated circuit (ASIC), a system on chip (SOC), other hardware circuits, and combinations thereof.

Placing sensed drilling parameters from the sensor nodes Sn into a common reference frame enables evaluation of the operation and performance of the drill string as a whole and comparison of the operation and performance of one drill string 130 to the operation and performance of another drill string 130. For example, detection of a lateral acceleration or lateral movement in one sensor node Sn may indicate that the drill string has shifted laterally, has buckled and is whirling in at least a section between two endpoints (e.g., like a jump-rope), is generating inaccurate readings, or is exhibiting some other drill string behavior involving lateral acceleration or movement. When the sensed parameters from that sensor node Sn are in a different reference plane from the sensed parameters from another sensor node Sn, comparison between the sensed parameters may yield no insight into the behavior of the drill string 130 as a whole or as a combination of parts because the relative starting and ending points and relative orientations are unknown. Moreover, when the sensed parameters from the sensor nodes Sn are not in a common reference plane, comparison between different drill strings 130 may yield no insight into the relative performance thereof because the relative starting and ending points and relative orientations are unknown. By placing the sensed drilling parameters into a common reference plane in accordance with the embodiments disclosed herein, an operator or other evaluator may better understand the behavior of the drill string 130, compare the behaviors of drill strings 130 to one another, and better control a drill string 130 during operation, design drilling tools and assemblies, and verify simulation models.

Additional non-limiting example embodiments of the disclosure are described below.

Embodiment 1: A wellbore sensor system, comprising: a drill string operably coupled to a drilling element configured to drill through a formation; a plurality of sensor nodes including at least: a first sensor node operably coupled to the drill string at a first location and comprising one or more first sensors including a first spatial sensor; and a second sensor node operably coupled to the drill string at a second location offset from the first location along a length of the drill string, the second sensor node comprising one or more second sensors including a second spatial sensor; a non-transitory data collection system configured to store sensor data from the plurality of sensor nodes therein; and one or more control circuits configured to: receive the sensor data from the first sensor node and the second sensor node; estimate, using the sensor data from the first spatial sensor and the second spatial sensor, parameters of a mathematical transform configured to transform sensor readings from the second sensor node in a second spatial frame of reference of the second sensor node into a first spatial frame of reference of the first sensor node; and transform the sensor readings from the second sensor node into the first spatial frame of reference using the estimated mathematical transform.

Embodiment 2: The wellbore sensor system of Embodiment 1, wherein the plurality of sensor nodes further includes a third sensor node operably coupled to the drill string a third location offset from the first location and the second location along the length of the drill string, wherein the one or more control circuits are further configured to: receive the sensor data from the third sensor node; estimate, using the sensor data from the first spatial sensor and the third spatial sensor, parameters of another mathematical transform configured to transform sensor readings from the third sensor node in a third spatial frame of reference of the third sensor node into the first spatial frame of reference; and transform the sensor readings from the third sensor node into the first spatial frame of reference using the estimated other mathematical transform.

Embodiment 3: The wellbore sensor system according to either one of Embodiment 1 and Embodiment 2, wherein frames of reference of each of the plurality of sensor nodes share substantially a same vertical axis.

Embodiment 4: The wellbore sensor system according to any one of Embodiments 1 through 3, wherein the vertical axis is substantially parallel to a longitudinal length of the drill string.

Embodiment 5: The wellbore sensor system according to any one of Embodiments 1 through 4, wherein the first sensor node includes the one or more control circuits.

Embodiment 6: The wellbore sensor system according to any one of Embodiments 1 through 5, wherein the non-transitory data collection system comprises a dedicated, non-transitory memory operably connected to each sensor node and configured to collect and store sensor data therefrom and wherein the one or more control circuits are configured to receive the sensor data from the first sensor node and the second sensor node after drilling is complete.

Embodiment 7: The wellbore sensor system according to any one of Embodiments 1 through 6, wherein the first spatial sensor and the second spatial sensor each include at least one of an accelerometer, a magnetometer, and a gyroscope.

Embodiment 8: The wellbore sensor system of according to Embodiment 7, wherein the accelerometer includes a three-axis accelerometer.

Embodiment 9: The wellbore sensor system of according to any one of Embodiments 1 through 8, wherein each of the plurality of sensor nodes includes at least one sensor selected from the list consisting of a pressure sensor, a temperature sensor, an elevation sensor, an electromagnetic sensor, and an acoustic sensor.

Embodiment 10: The wellbore sensor system of according to any one of Embodiments 1 through 5 and 7 through 9, further comprising a wellbore communication system operably coupled to each of the sensor nodes and configured to transmit the sensor data to the non-transitory data collection system in real time, the wellbore communication system comprising at least one communication system selected from the list consisting of an acoustic communication system, an electrical communication system, a galvanic communication system, and a fiber-optic communication system.

Embodiment 11: The wellbore sensor system according to Embodiment 10, wherein each of at least two of the sensor nodes includes a control circuit of the one or more control circuits, wherein the one or more control circuits are configured to communicate with each other through the wellbore communication system.

Embodiment 12: The wellbore sensor system according to Embodiment 11, wherein the one or more control circuits are configured to transmit transformed sensor readings to surface equipment through the wellbore communication system.

Embodiment 13: The wellbore sensor system according to any one of Embodiments 1 through 12, wherein the plurality of sensor nodes further comprises another sensor node located at the drilling element.

Embodiment 14: A method of transforming wellbore sensor data into a common spatial frame of reference, the method comprising: taking first sensor readings with a first sensor node operably coupled to a drill string at a first location, the first sensor readings taken relative to a first spatial frame of reference of the first sensor node; taking second sensor readings with a second sensor node operably coupled to the drill string at a second location offset from the first location along the length of the drill string, the second sensor readings taken relative to a second spatial frame of reference of the second sensor node; using the first sensor readings and the second sensor readings to estimate parameters of a mathematical transform configured to transform the second sensor readings into the first spatial frame of reference; and transforming the second sensor readings into the first spatial frame of reference with the estimated mathematical transform.

Embodiment 15: The method of Embodiment 14, wherein estimating parameters of a mathematical transform comprises estimating differences between spatial orientation and position of the second spatial frame of reference with respect to the first spatial frame of reference for three rotational degrees of freedom and three positional degrees of freedom.

Embodiment 16: The method according to either one of Embodiment 14 and Embodiment 15, wherein estimating parameters of a mathematical transform comprises: estimating frequencies with which the first sensor node and the second sensor node are rotating by analyzing magnetometer data from the first sensor readings and the second sensor readings, respectively; computing numeric regressions of the magnetometer data from the first sensor readings and the second sensor readings using the estimated frequencies to estimate an instantaneous bias parameter, an acceleration parameter, and a phase parameter of the magnetometer data for each of the first sensor node and the second sensor node; estimating rotational transforms configured to rotate the second sensor readings taken in the second spatial frame of reference such that coordinate axes of the second spatial frame of reference are parallel to corresponding coordinate axes of the first spatial frame of reference; estimating positional transforms configured to shift the second sensor readings taken in the second spatial frame of reference such that a vertex of the coordinate axes of the second spatial frame of reference coincides with a vertex of the coordinate axes of the first spatial frame of reference; and applying the rotational transforms and the positional transforms to the second sensor readings to transform the second sensor readings into the first spatial frame of reference.

Embodiment 17: The method according to Embodiment 16, wherein computing numeric regressions of the magnetometer data comprises performing at least one of cosinor regressions and nonlinear regressions.

Embodiment 18: The method according to either one of Embodiment 16 and Embodiment 17, wherein estimating rotational transforms comprises computing a normal, orientation, approach computation to rotate and align the second sensor readings for two degrees of rotational freedom with the first spatial frame of reference.

Embodiment 19: The method according to any one of Embodiments 16 through 18, wherein: estimating rotational transforms comprises estimating two separate rotational transforms including a first rotational transform for a first degree of rotational freedom and a second rotational transform for second and third degrees of rotational freedom; estimating positional transforms comprises estimating separate positional transforms for each of three positional degrees of freedom; and applying the rotational transforms and the positional transforms to the second sensor readings comprises computing a matrix dot product of each of the rotational transforms and the three positional transforms to obtain a single combined transform, and applying the single combined transform to the second sensor readings.

Embodiment 20: The method according to any one of Embodiments 14 through 19, further comprising synchronizing a second time monitor of the second sensor node with a first time monitor of the first sensor node.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure and as hereinafter claimed, including legal equivalents thereof. In addition, features from one embodiment may be combined with features of another embodiment while still being encompassed within the scope of the disclosure. Further, embodiments of the disclosure have utility with different and various types and configurations of tools and materials.

What is claimed is:

1. A control system for operating a drill string in a wellbore, comprising:

a drill string operably coupled to a drilling element configured to drill through a formation;

a plurality of sensor nodes including at least:

a first sensor node operably coupled to the drill string at a first location and comprising one or more first sensors including a first spatial sensor;

a second sensor node operably coupled to the drill string at a second location offset from the first location along a length of the drill string, the second sensor node comprising one or more second sensors including a second spatial sensor;

a non-transitory data collection system configured to store sensor data from the plurality of sensor nodes therein; and one or more control circuits operably configured to receive the sensor data from the first sensor node and the second sensor node, the one or more control circuits each including a processor operably coupled to a data storage device, the data storage device including computer-readable instructions stored thereon and the processor configured to execute the computer-readable instructions stored on the data storage device, the computer-readable instructions configured to instruct the processor to:

estimate, using the sensor data from the first spatial sensor and the second spatial sensor, parameters of a mathematical transform configured to transform sensor readings from the second sensor node in a second spatial frame of reference of the second sensor node into a first spatial frame of reference of the first sensor node;

transform the sensor readings from the second sensor node into the first spatial frame of reference using the estimated mathematical transform; and control an operational state of the drill string in response to the sensor data from the first sensor node and the second sensor node after transforming the sensor readings from the second sensor node into the first spatial frame of reference.

2. The control system of claim 1, wherein the plurality of sensor nodes further includes a third sensor node operably coupled to the drill string a third location offset from the first location and the second location along the length of the drill string, wherein the one or more control circuits are further configured to receive the sensor data from the third sensor node, and wherein the computer-readable instructions are further configured to instruct the processor to;

estimate, using the sensor data from the first spatial sensor and a third spatial sensor, parameters of another mathematical transform configured to transform sensor readings from the third sensor node in a third spatial frame of reference of the third sensor node into the first spatial frame of reference; and transform the sensor readings from the third sensor node into the first spatial frame of reference using the estimated other mathematical transform.

3. The control system of claim 1, wherein frames of reference of each of the plurality of sensor nodes share substantially a same vertical axis.

4. The control system of claim 3, wherein the vertical axis is substantially parallel to a longitudinal length of the drill string.

5. The control system of claim 1, wherein the first sensor node includes the one or more control circuits.

6. The control system of claim 1, wherein the non-transitory data collection system comprises a dedicated, non-transitory memory operably connected to each sensor node and configured to collect and store sensor data therefrom and wherein the one or more control circuits are configured to receive the sensor data from the first sensor node and the second sensor node after drilling is complete.

7. The control system of claim 1, wherein the first spatial sensor and the second spatial sensor each include at least one of an accelerometer, a magnetometer, and a gyroscope.

8. The control system of claim 7, wherein the accelerometer includes a three-axis accelerometer.

9. The control system of claim 1, wherein each of the plurality of sensor nodes includes at least one sensor selected from the list consisting of a pressure sensor, a temperature sensor, an elevation sensor, an electromagnetic sensor, and an acoustic sensor.

10. The control system of claim 1, further comprising a wellbore communication system operably coupled to each of the sensor nodes and configured to transmit the sensor data to the non-transitory data collection system in real time, the wellbore communication system comprising at least one communication system selected from the list consisting of an acoustic communication system, an electrical communication system, a galvanic communication system, and a fiber-optic communication system.

11. The control system of claim 10, wherein each of at least two of the sensor nodes includes a control circuit of the one or more control circuits, wherein the one or more control circuits are configured to communicate with each other through the wellbore communication system.

12. The control system of claim 11, wherein the one or more control circuits are configured to transmit transformed sensor readings to surface equipment through the wellbore communication system.

13. The control system of claim 1, wherein the plurality of sensor nodes further comprises another sensor node located at the drilling element.

14. A method of controlling a drill string in a wellbore at least partially by transforming sensor data into a common spatial frame of reference, the method comprising:

taking first sensor readings with a first sensor node operably coupled to a drill string at a first location, the first sensor readings taken relative to a first spatial frame of reference of the first sensor node;

taking second sensor readings with a second sensor node operably coupled to the drill string at a second location offset from the first location along a length of the drill string, the second sensor readings taken relative to a second spatial frame of reference of the second sensor node;

executing computer-readable instructions stored on a data storage device with a processor, the computer-readable instructions configured to instruct the processor to perform operations including:

using the first sensor readings and the second sensor readings to estimate parameters of a mathematical transform configured to transform the second sensor readings into the first spatial frame of reference;

transforming the second sensor readings into the first spatial frame of reference with the estimated parameters of the mathematical transform; and control an operational state of the drill string in response to the sensor data from the first sensor node and the second sensor node after transforming the first sensor readings from the second sensor node into the first spatial frame of reference.

15. The method of claim 14, wherein estimating parameters of a mathematical transform comprises estimating differences between spatial orientation and position of the second spatial frame of reference with respect to the first spatial frame of reference for three rotational degrees of freedom and three positional degrees of freedom.

16. The method of claim 14, wherein estimating parameters of a mathematical transform comprises:

estimating frequencies with which the first sensor node and the second sensor node are rotating by analyzing magnetometer data from the first sensor readings and the second sensor readings, respectively;

computing numeric regressions of the magnetometer data from the first sensor readings and the second sensor readings using the estimated frequencies to estimate an instantaneous bias parameter, an acceleration parameter, and a phase parameter of the magnetometer data for each of the first sensor node and the second sensor node;

estimating rotational transforms configured to rotate the second sensor readings taken in the second spatial frame of reference such that coordinate axes of the second spatial frame of reference are parallel to corresponding coordinate axes of the first spatial frame of reference;

estimating positional transforms configured to shift the second sensor readings taken in the second spatial frame of reference such that a vertex of the coordinate axes of the second spatial frame of reference coincides with a vertex of the coordinate axes of the first spatial frame of reference; and applying the rotational transforms and the positional transforms to the second sensor readings to transform the second sensor readings into the first spatial frame of reference.

17. The method of claim 16, wherein computing numeric regressions of the magnetometer data comprises performing at least one of regressions and nonlinear regressions.

18. The method of claim 16, wherein estimating rotational transforms comprises computing a normal, orientation, approach computation to rotate and align the second sensor readings for two degrees of rotational freedom with the first spatial frame of reference.

19. The method of claim 16, wherein:

estimating rotational transforms comprises estimating two separate rotational transforms including a first rotational transform for a first degree of rotational freedom and a second rotational transform for second and third degrees of rotational freedom;

estimating positional transforms comprises estimating separate positional transforms for each of three positional degrees of freedom; and applying the rotational transforms and the positional transforms to the second sensor readings comprises computing a matrix dot product of each of the rotational transforms and the three positional transforms to obtain a single combined transform, and applying the single combined transform to the second sensor readings.

20. The method of claim 14, further comprising synchronizing a second time monitor of the second sensor node with a first time monitor of the first sensor node.

* * * * *